United States Patent [19]

Tilston

[11] Patent Number: 4,607,487

[45] Date of Patent: Aug. 26, 1986

[54] COMBUSTION CHAMBER WALL COOLING

[75] Inventor: John R. Tilston, Farnham, England

[73] Assignee: The Secretary of State for Defence in Her Britannic Majesty's Government of the United Kingdom of Great Britain and Northern Ireland, London, England

[21] Appl. No.: 686,384

[22] Filed: Dec. 26, 1984

Related U.S. Application Data

[63] Continuation-in-part of Ser. No. 447,804, Dec. 8, 1982, abandoned.

[30] Foreign Application Priority Data

Dec. 31, 1981 [GB] United Kingdom ..... 8139167

[51] Int. Cl.[4] ..... F02C 1/00; F02G 3/00; F23M 9/00

[52] U.S. Cl. ..... 60/752; 60/759; 431/182

[58] Field of Search ..... 60/752, 755, 757, 756, 60/759, 753, 754, 758, 760; 431/182, 351

[56] References Cited

U.S. PATENT DOCUMENTS

| | | | |
|---|---|---|---|
| 3,274,752 | 9/1966 | Huyghe et al. | 165/109 |
| 3,934,574 | 1/1976 | Johnson | 165/174 |
| 3,981,675 | 9/1976 | Szetela | 431/351 |
| 4,288,980 | 9/1981 | Ernst | 60/759 |

FOREIGN PATENT DOCUMENTS

| | | | |
|---|---|---|---|
| 1747 | 1/1977 | Japan | 165/174 |
| 168019 | 12/1981 | Japan | 431/351 |
| 2074308 | 10/1981 | United Kingdom | 60/752 |
| 200964 | 12/1968 | U.S.S.R. | 60/752 |

*Primary Examiner*—Louis J. Casaregola
*Assistant Examiner*—Timothy S. Thorpe
*Attorney, Agent, or Firm*—Stevens, Davis, Miller & Mosher

[57] ABSTRACT

A gas turbine combustion including a combustion wall having a plurality of generally cylindrical passages therein which extend around and are generally parallel to, the chamber axis, each of said passages having a series of air inlets disposed along the passage and tangentially directed thereinto, generally towards the center of the chamber, and means for directing cooling air into the series of air inlets in each passage to set up a forced vortex therein. The series of air inlets may be arranged to set up forced vortices of opposite rotation in adjacent passage. A means for directing cooling air into the tube inlets may comprise an annular shroud which extends around the air inlets and directs airflow into the air inlets.

5 Claims, 5 Drawing Figures

COMBUSTION CHAMBER WALL COOLING

This application is a continuation-in-part of our copending parent application Ser. No. 447,804 filed Dec. 8, 1982, now abandoned, in the name of J. R. TILSTON and entitled 'Combustion Chamber Wall Cooling'.

The present invention relates to the cooling of the walls of combustion chambers used in gas turbine engines.

To ensure acceptable lives for combustion chambers without the use of excessively thick wall structure it is usual to use some form of wall cooling. Known forms of wall cooling all have disadvantages.

In film cooling, which is the most commonly used, where a film of cooling air is directed over the inner walls of a chamber, the air intermixes with the combustion gases. This causes the cooling air to be diverted from the wall and also results in disturbance of the combustion process with consequent loss of efficiency and increased pollution.

Convective cooling, where cooling air is blown over the outside wall of a combustion chamber, has its ultimate perormance limited by the rapid heating of the coolant adjacent to the wall.

Potentially the most efficient form of cooling is impingement cooling where jets of cooling air are directed against an outer wall surface. In practice, however, flow past the wall generated by upstream jets is found to deflect downstream jets and so dilute the downstream cooling effect.

It has been proposed to cooling tubes mounted on the inner wall of gas turbine combustion chamber. U.S. Pat. No. 4,288,980 discloses such a chamber and coding tubes for directing cooling air counter to the direction of flow of combustion gases out of the chamber.

U.S. Pat. No. 4,288,980 discloses tube type heat exchangers utilizing meaans for imparting a spiraling motion to heat transfer medium.

The present invention provides improved cooling for gas turbine combustion chambers.

According to the present invention a gas turbine combustion chamber includes a combustion chamber wall having a plurality of generally cylindrical passages therein which extend around and are generally parallel to, the chamber axis, each of said passages having a series of air inlets disposed along the passage and tangentially directed thereinto, generally towards the centre of the chamber, and means for directing cooling air into the series of air inlets in each said passage to set up a forced vortex therein.

The series of air inlets may be arranged to set up forced vortices of opposite rotation in adjacent passages. The passages may be arranged in pairs with the passages of each pair closely spaced the one from the other, wherein the series of air inlets are in oppsosite portions of the passages of each pair.

According to a further aspect of the invention, a gas turbine combustion chamber includes a plurality of touching tubes which extend generally parallel to the chamber axis to form at least part of a wall thereof, each of said tubes having an air inlet comprising an axially extending series of tangentially directed holes, and means for directing cooling air into the tube inlets to set up a forced vortex therein.

The means for directing cooling air may comprise an annular shroud which extends around the air inlets and directs airflow into the air inlets.

The chamber may be of annular configuration and have inner and outer walls which include said generally cylindrical passages or are formed by said tubes, or the chamber may be of cylindrical configuration.

The inlet ends of the passages may be situated at or near the upsteam end of the combustion chamber.

The chamber may include an annular shroud which extends around the air inlet holes and which, in use, directs cold air flowing past the chamber into the inlet holes.

One embodiment of the invention will now be described, by way of example only, with reference to the accompanying diagrammatic drawings, of which:

Figure 1:
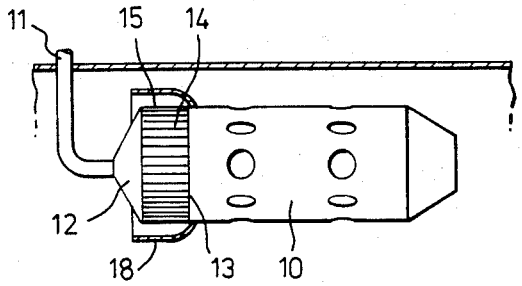
FIG. 1 is an elevation in section of a combustion chamber.

A gas turbine engine combustion chamber 10 (FIG. 1), of the type wherein several chambers are arranged annularly downstream of a compressor (not shown), has a fuel supply 11, means for mixing the fuel with air and means for igniting the fuel/air mixture. Means for mixing fuel with air and of igniting the mixture are well known in the art, form no part of the present invention and hence are not illustrated or described herein. Adjacent an upstream end 12 of the combustion chamber 10 a section of a wall 13 of the chamber is formed from an annular arrangement 14 of touching tubes such as those shown at 15.

Figure 2:
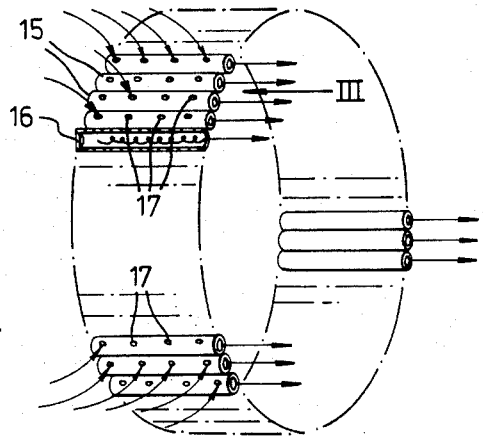
FIG. 2 is a perspective view, partly cut-away, and partly in section of a detail of FIG. 1.
Figure 3:
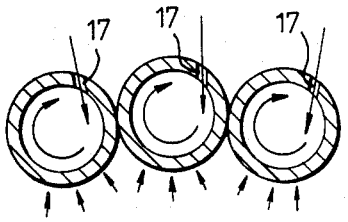
FIG. 3 is an end view of a detail of FIG. 2 in the direction of arrow 3 in FIG. 2.

As best seen in FIGS. 2 and 3 each tube 15 is closed at an upstream end 16 and has an axially extending series of holes 17 each (FIG. 3) tangentially directed into the tube.

Figure 4:
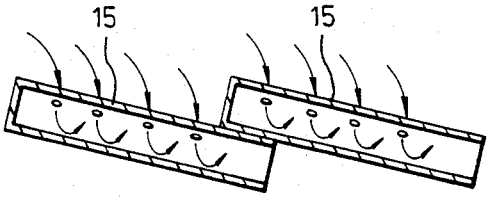
FIG. 4 is an elevation in section of a detail of an extended version of the invention.

In use, with the engine running, air supplied by the compressor is in part admitted to the combustion chamber 10 to mix with fuel from the fuel supply 11 and support combustion within the chamber. Further air (which may be channelled by a guide such as that shown at 18 in FIG. 1) passes through the holes 17 in tubes 15. The air within the tubes 15 is forced into vortical motion (FIGS. 3, 4), the pitch of the vortex increasing in the downstream direction as air from downstream holes 17 is added to air already in the tubes. After fulfilling its cooling function within the tubes 15 the air is ejected into the combustion chamber 10 where it may well be cool enough to perform a cooling function within the tubes 15 the air is ejected into the combustion chamber 10 where it may well be cool enough to perform a cooling function along the inside of wall 13. Alternatively, as illustrated in FIG. 4, a series of overlapping annular arrangements of tubes 15 may extend downstream along the wall 13.

It will be realised that an annular combustion chamber according to the invention will have at least one arrangement of tubes 15 adjacent the upstream end of each of its inner and outer walls.

With this arrangement cooler air introduced through downstream holes 17 will, due to its greater density and the effect of the vortical motion, tend to circulate at the surface of tubes 15 at the expense of already heated and hence less dense air already within the tube. The arrangement therefore provides efficient wall cooling.

The arrangement also ensures that failure of one or more tubes 15 will occur on the inside arcs (relative to the inside of the combustion chamber 10), allowing flow of cooling air to within the chamber to continue through holes 17, and also preventing escape of hot combustion gases through wall 13 by the presence of remaining arcs of tubes 15.

Figure 5:
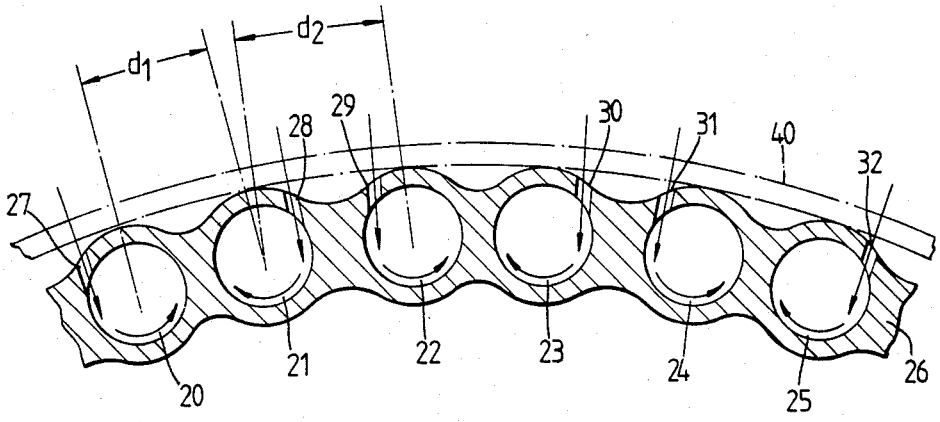
FIG. 5 is an end view of part of a combustion chamber wall of a further embodiment of the invention.

Referring to FIG. 5, an annular arrangement can be conveniently be constructed by drilling cylindrical passages 20 to 25 in a tubular chamber wall 26, rather than fabricating a chamber from individual tubes. In the embodiment of FIG. 5 the cooling passages upstream of a cylindrical casing 40, shown in dotted lines, are arranged in pairs 20,21 and 22,23 and 24,25 with the passages of each pair closely spaced the one from the other; thus, in FIG. 5, the spacing $d_1$ and $d_2$ the passage centres is such that $d_2 > d_1$. Further, the passages have air inlets 27 to 32 which are in opposite portions of the passages of each pair. Thus, for example, passages 27 and 28 are in opposite portions of the pair of passages 20 and 21. The arrows in FIG. 5 indicate the rotational direction (when viewed from the rear of the combustion chamber) of the air flow in the passages. It has been found that by using the vortex flow shown, pairs of vortices, for example from passages 20,21, tend to propagate along the downstream casing 40 and provide a stable cooling layer of air.

I claim:

1. A gas turbine combustion chamber including a combustion chamber wall wherein at least part of the wall is formed by a plurality of generally cylindrical touching tubes forming cooling passages which extend around, and are generally parallel to, the chamber axis, each of said passages having a series of air inlets disposed along the passage and tangentially directed thereinto, and means for directing cooling air into the series of air inlets in each said passage to set up a forced vortex therein, the passages having open ends which exhaust directly into the combustion chamber.

2. A gas turbine combustion chamber as claimed in claim 1 wherein said series of air inlets are arranged to set up forced vortices of opposite rotation in adjacent passages.

3. A gas turbine combustion chamber as in claim 2 wherein the passages are arranged in pairs within the passages of each pair closely spaced the one from the other, and wherein said series of air inlets are in opposite portions of the passages of each pair.

4. A gas turbine combustion chamber as in claim 1 wherein said means for directing cooling air comprises an annular shroud which extends around said air inlets and directs airflow into said air inlets.

5. A gas turbine combustion chamber as claimed in claim 1 in which the air flow through the combustion chamber and the cooling tubes is in generally the same direction.

* * * * *